United States Patent [19]

Bergmann et al.

[11] Patent Number: 5,072,670

[45] Date of Patent: Dec. 17, 1991

[54] GAP COVER FOR BLANKET CYLINDERS IN SHEET-FED OFFSET ROTARY PRESSES

[75] Inventors: Marco Bergmann, Offenbach am Main; Herbert Rebel, Rodgau, both of Fed. Rep. of Germany

[73] Assignee: MAN Roland Druckmaschinen AG, Fed. Rep. of Germany

[21] Appl. No.: 575,067

[22] Filed: Aug. 30, 1990

[30] Foreign Application Priority Data

Aug. 30, 1989 [DE] Fed. Rep. of Germany ..... 3928640

[51] Int. Cl.[5] ..... B41F 13/42

[52] U.S. Cl. ..... 101/415.1; 101/DIG. 36

[58] Field of Search ..... 101/415.1, DIG. 36, 101/378, 375

[56] References Cited

U.S. PATENT DOCUMENTS 4,357,093 11/1982 Caudill et al. ..... 101/415.1
4,742,769 5/1988 Zeller ..... 101/415.1
4,815,380 3/1989 Fischer ..... 101/415.1

FOREIGN PATENT DOCUMENTS 3337111 10/1984 Fed. Rep. of Germany ... 101/415.1
225102 7/1985 Fed. Rep. of Germany ... 101/415.1
364594 6/1930 United Kingdom ..... 101/415.1

*Primary Examiner*—Edgar S. Burr
*Assistant Examiner*—Joseph R. Keating
*Attorney, Agent, or Firm*—Leydig, Voit & Mayer

[57] ABSTRACT

A blanket cylinder is covered by a blanket having ends secured by spindles in a wide gap extending parallel to the central axis of the cylinder. The cylinder includes a cover rail having a substantially mushroom-shaped cross-section disposed along the length of the gap. The cover rail is attached to the base of the gap so that the cover rail bears against the blanket secured on the spindles and sealing material is provided between the end walls of the cylinder and the adjacent surfaces of the cover rail.

5 Claims, 1 Drawing Sheet

GAP COVER FOR BLANKET CYLINDERS IN SHEET-FED OFFSET ROTARY PRESSES

FIELD OF THE INVENTION

The present invention relates generally to blanket cylinders for sheet-fed offset rotary presses and more particularly concerns a device for covering and sealing the gap in the blanket cylinder of such presses.

BACKGROUND OF THE INVENTION

Generally, it is known in the art of printing presses to equip a blanket cylinder with a device for covering the gap in the cylinder. A common disadvantage of such prior art devices is that the gap cover does not give optimum protection against penetration by liquid detergents used for cleaning the cylinders, or penetration by water or ink-water emulsions. Another typical problem is that the gap-covering device disposed in the gap cannot adequately compensate the imbalance of the rotating blanket cylinder, because the mass of the gap-covering components is insufficient in size and distribution to counteract the dynamic imbalance.

In the prior art, it is admittedly known from DE-OS 3 110 982, for example, to provide filler members in the gap of a blanket cylinder. It is also known from DE-PS 3 540 581, DE-OS 3 644 501, and DE-PS 3 705 594 to dispose a rail-like supporting bar along the entire length of the gap and secure it to the base thereof. These devices, however, do not seal the gap in optimum manner against penetration of detergents or the like, because the gap cannot be reliably sealed on all sides. In addition, these filling members or supporting bars are clearly intended only for reel presses, where the blanket cylinders have a narrow gap, and are consequently unsuitable for blanket cylinders for sheet-fed rotary offset presses, which have a wide gap covering about 90° of the cylinder circumference.

In DE-AS 2,707,643 a rounded cap-like member is disposed to partially cover the gap of a blanket cylinder. However, because this cap member is also disposed to engage and tilt open the clamping bars on the blanket holding spindles, substantial openings leading into the gap are left unsealed.

OBJECTS AND SUMMARY OF THE INVENTION

It is a primary object of the present invention to provide a rail for covering the wide gap in a sheet-fed offset rotary press and adapted, in cooperation with the clamped blanket, to seal the entire gap region against penetration of liquids. It is a related object to provide a cover rail which also prevents the blanket from coming loose and also improves the compensation of the imbalance of the rotating blanket cylinder.

According to the present invention, a blanket cylinder is provided for sheet-fed offset rotary presses which is covered by a blanket having ends secured by spindles in a wide gap which extends parallel to the central axis of the cylinder. The cylinder includes a cover rail having a substantially mushroom-shaped cross-section which is disposed in the gap of the cylinder and extends along the entire length of the gap between the end walls of the cylinder. The rail is attached to the base of the gap such that the rail head bears directly against the blanket secured on the spindles of the cylinder and sealing material is provided between the end walls of the cylinder and adjacent surfaces of the rail head.

The main advantage of the cover rail according to the present invention is that liquid detergents, water or the like can no longer penetrate into the gap in the blanket cylinder, thus preventing the printing process from being contaminated by accumulations of such liquids in the gap. The parts of the blanket cylinder under the cover rail, including the devices for clamping the blanket or for dressings or the like, are also more effectively protected against corrosion. In addition, the cover rail according to the invention fills the space between the spindles and thus provides a suitable counter-weight, for improved compensation of imbalances occurring in sheet-fed rotary offset printing presses. The cover rail also has a wide head which holds the blanket in position, thus reducing the possibility of the blanket coming loose. A final advantage is that the cover rail protects the operators from injury in the wide gap.

These and other features and advantages of the invention will become more apparent from the following detailed description when taken in conjunction with the accompanying drawings.

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention.

DETAILED DESCRIPTION OF THE PREFERRED EMBODIMENT

Figure 2:
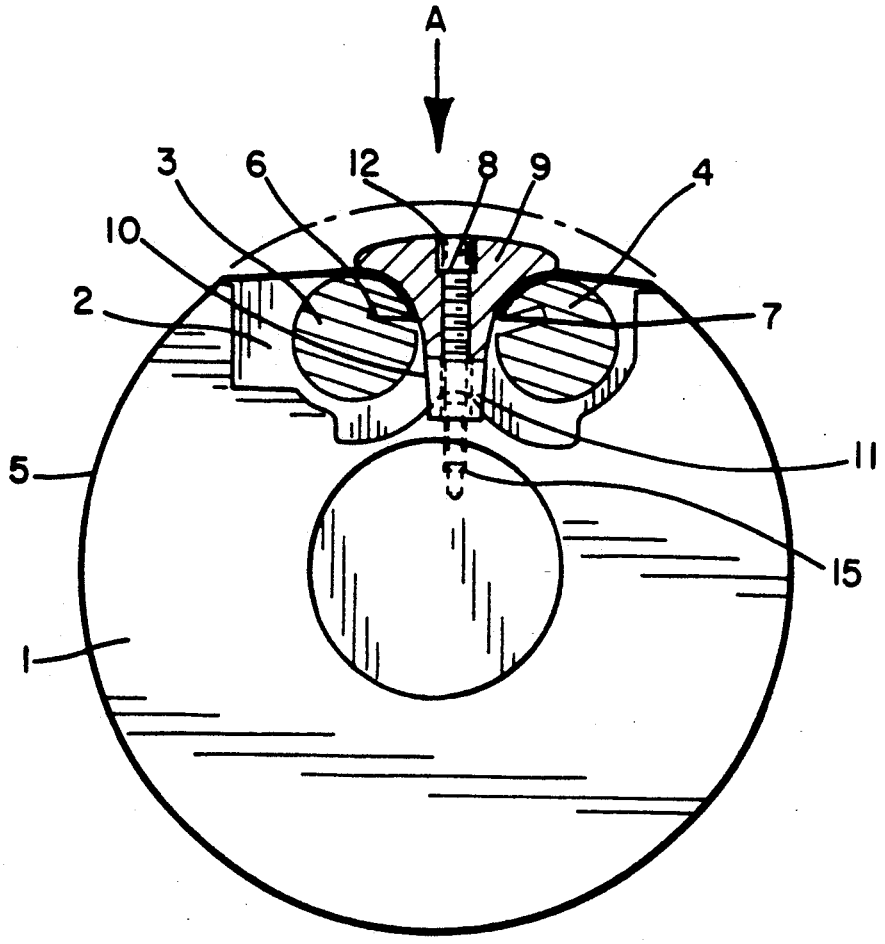
FIG. 2 is a sectional side view of the blanket cylinder including a clamped blanket and showing the cover rail of the present invention.
Figure 1:
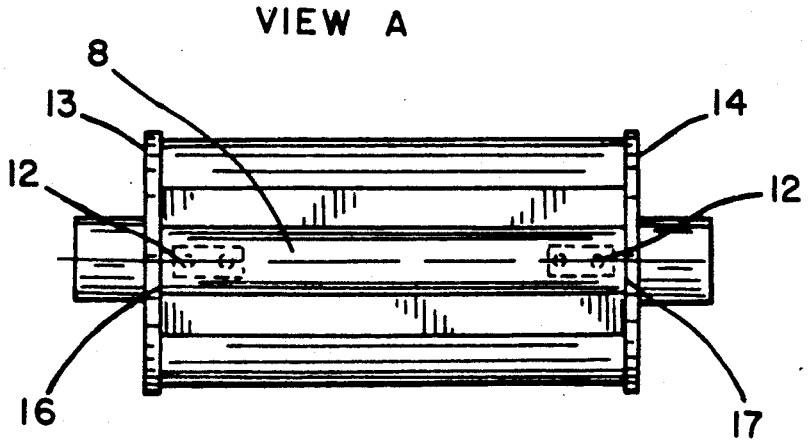
FIG. 1 is a plan view of the blanket cylinder of the present invention.

Turning now to the drawings, a blanket cylinder 1 for a printing press is shown, somewhat diagrammatically. The cylinder 1 has a gap 2 parallel to its axis, and a blanket 5 is clamped on the cylinder as seen in FIG. 2. The ends 6 and 7 of the blanket 5 are inserted into the gap 2 and held on spindles 3 and 4, which are tightened so as to secure the blanket 5 to the surface of the blanket cylinder 1. In the process, the blanket 5 is pulled taut over the edges of the gap.

According to the present invention, a cover rail 8 is disposed in and sealingly closes the gap 2. The rail 8 is inserted into the gap through the open space between the two spindles 3, 4 and is rigidly secured to the base 11 of the gap 2 by screws 12, which are guided through bores in the rail 8 and are adapted to be screwed into threaded bores 15 in the base 11 of the gap 2.

The cover rail 8 extends over the entire length of gap 2, almost up to the end walls 13, 14 of the blanket cylinder 1, and has an essentially mushroom-shaped cross-section having a head portion 9 and a stem portion 10. The rail head 9 is dimensioned so that its width is substantially equal to the distance between the central axes of the clamping spindles 3 and 4. As shown in FIG. 2, the rounded under surface of the rail head 9 rests on the spindles 3, 4, along the gap 2 with the clamped blanket 5 disposed therebetween. Also in keeping with the invention, a sealing material 16, 17, made of an elastomeric plastic is disposed between the end walls 13, 14 of the cylinder 1 and the end surfaces of the rail head 9 to further seal the gap 2.

In this manner the rail head 9 is sealed over the gap 2 on all sides. The cover rail 8, which is preferably made of metal, such as cast iron also counterbalances the dynamic imbalance of the blanket cylinder 1. Additionally, the cover rail 8 prevents the blanket 5 from coming loose from the edges of the gap, since the rail head 9 is in contact with the blanket 5, which is gently but sealingly clamped by the screwed-in rail 8. Pursuant to this aspect of the present invention, the cover rail 8 is curved in the region of the transition from the stem portion 10 to the head portion 9. Preferably and as shown in FIG. 2, the radius of curvature is approximately equal to the curvature of the blanket 5 wound on the spindles 3, 4 such as to sealingly clamp the thickness of blanket 5 between the cover rail 8 and spindles 3, 4.

From the foregoing it will understood that the present invention provides a device for covering the wide gap of a blanket cylinder which is covered by a blanket having ends secured by spindles in the gap. The device includes an elongated cover rail having a substantially mushroom-shaped cross-section which is disposed longitudinally in the gap of the cylinder. The cover rail is rigidly attached to the base of the gap such that the underside of the rail head bears against the blanket secured on the spindles and sealing material is provided between the end walls of the cylinder and the adjacent surfaces of the rail to completely seal the gap from entry of ink, water, cleaning fluids and the like.

We claim as our invention:

1. A blanket cylinder for sheet-fed rotary printing presses comprising in combination, an elongated cylinder including end walls at each end of the cylinder and a wide gap extending parallel to the central axis of the cylinder having a lower base portion, a pair of clamping spindles disposed in said gap, a blanket adapted to cover said cylinder having ends secured by said clamping spindles in said gap, an elongated cover rail disposed in said gap along the entire longitudinal length thereof up to said end walls of the cylinder, said cover rail having a substantially mushroom-shaped cross-section including a rounded head portion and a depending stem portion, said rail head portion having a width formed approximately equal to the distance between the central axes of said clamping spindles and being adapted to bear against said spindles in said gap with said blanket disposed therebetween, means for rigidly securing said cover rail to said base of the gap, and means for sealing between said end walls of the cylinder and the adjacent end surfaces of said cover rail.

2. A blanket cylinder according to claim 1 wherein the transition from said stem portion to said head portion of said cover rail is formed with a curvature approximately equal to the curvature of the blanket wound on the spindles.

3. A blanket cylinder according to claim 1 wherein said cover rail is made of cast iron.

4. A blanket cylinder according to claim 1 wherein said sealing means includes a sealing material made of an elastomeric plastic.

5. A blanket cylinder according to claim 1 wherein said securing means includes screws for attaching said cover rail to said base of the gap.

* * * * *